US010132142B2

(12) United States Patent
Veland

(10) Patent No.: US 10,132,142 B2
(45) Date of Patent: Nov. 20, 2018

(54) FLUID PROCESSING MACHINES WITH BALANCE PISTON ON INLET

(71) Applicant: ONESUBSEA IP UK LIMITED, London (GB)

(72) Inventor: Arne Veland, Bergen (NO)

(73) Assignee: OneSubsea IP UK Limited (GB)

( * ) Notice: Subject to any disclaimer, the term of this patent is extended or adjusted under 35 U.S.C. 154(b) by 215 days.

(21) Appl. No.: 14/982,083

(22) Filed: Dec. 29, 2015

(65) Prior Publication Data

US 2017/0183942 A1 Jun. 29, 2017

(51) Int. Cl.

| | |
|---|---|
| ***E21B 43/12*** | (2006.01) |
| ***F04D 3/00*** | (2006.01) |
| ***E21B 43/20*** | (2006.01) |

(52) U.S. Cl.

CPC ..... *E21B 43/121* (2013.01); *E21B 43/128* (2013.01); *E21B 43/20* (2013.01); *F04D 3/00* (2013.01)

(58) Field of Classification Search

CPC ..... E21B 43/121; E21B 43/128; E21B 43/20; F04D 3/00

See application file for complete search history.

(56) References Cited

U.S. PATENT DOCUMENTS

2010/0284829 A1* 11/2010 Sloteman ..... F04D 9/003 417/199.1
2012/0321438 A1* 12/2012 Vannini ..... F04D 13/08 415/1

FOREIGN PATENT DOCUMENTS

WO WO-2014153345 A1 * 9/2014 ..... F04D 3/00

* cited by examiner

*Primary Examiner* — James G Sayre
(74) *Attorney, Agent, or Firm* — Conley Rose, P.C.

(57) ABSTRACT

A subsea pump is used in applications such as deep-water boosting of fluid produced from a wellbore. The process pressure variation is mostly related to the pump suction side in such applications. The barrier fluid system for the pump regulates its pressure according to the pump discharge pressure. A balance piston is positioned in a location close to the pump inlet such that both mechanical seals are exposed to the pump discharge pressure on the process side.

27 Claims, 6 Drawing Sheets

FLUID PROCESSING MACHINES WITH BALANCE PISTON ON INLET

TECHNICAL FIELD

The present disclosure relates to subsea fluid processing machines. More particularly, the present disclosure relates to rotating fluid processing machines such as subsea pumps and compressors with a balance piston located on the inlet or suction side of the machine.

BACKGROUND

In conventional subsea pumps with a balance piston, the balance piston is placed at or near the pump outlet, or pump discharge. This solution is also described in textbooks as A. J. Stepanoff, "Centrifugal and Axial Flows Pumps, Design, and Application" 2nd Ed., Chapter 11.2 (1993); and J. F. Gulich "Centrifugal Pumps" 3rd Ed., Chapter 9.2.3 (2014). This location is favorable because for many pump applications there are greater variations in pressure at the pump discharge side than at the pump suction side. Indeed, for many applications the pump inlet pressure is relatively constant. A typical subsea application where this is the case is the injection of raw seawater, where the pump inlet pressure is relatively constant and is dictated by the ambient seawater pressure.

There have been some proposals to configure the balance piston in other ways. For example, in a subsea water injection system, in order to achieve enough discharge pressure, the system can consist of two water injection pumps operated in series. The second pump has a balance piston located in both ends. With such a solution, all seal chambers on both pumps are drained back to the suction (inlet) of the first pump. The barrier fluid pressure for both pumps is therefore regulated according to the first pump suction pressure. A disadvantage with this solution is that the balance piston on pump outlet for the second pump sees the total differential pressure for both pumps. This effectively limits the total differential pressure.

SUMMARY

This summary is provided to introduce a selection of concepts that are further described below in the detailed description. This summary is not intended to identify key or essential features of the claimed subject matter, nor is it intended to alter or limit the scope of the claimed subject matter.

According to some embodiments, a fluid pressure increasing machine is described that includes: a fluid processing chamber configured to contain a process fluid and includes a fluid inlet and a fluid outlet; a rotating member configured to rotate about a central longitudinal axis; and a plurality of impellers being fixedly mounted to the rotating member and exposed to the process fluid within the fluid processing chamber, such that when the member is rotated the impellers act on the process fluid thereby increasing pressure of the process fluid towards the fluid outlet and a reaction force is imparted on the rotating member in an axial direction from the fluid outlet toward the fluid inlet. A rotating balance piston is mounted in a fixed relationship with the rotating member and includes a first higher pressure surface area exposed to a first volume of the process fluid and a second lower pressure surface exposed to a second volume of the process fluid. The first volume is in fluid communication with and about the same pressure as the fluid outlet. The first and second volumes are configured such that while the member is rotating, fluid pressure in the first volume is higher than in the second volume, thereby imparting a force on the rotating member that at least partially counteracts the reaction force. A dynamic seal is configured to form a mechanical seal between the rotating balance piston and a non-rotating portion of the machine. The dynamic seal includes first and second seal portions that are separated by a seal channel. The seal channel separates a barrier fluid volume from the first volume of the process fluid.

According to some embodiments, a barrier fluid pressure regulation system is configured to regulate pressure of barrier fluid in the barrier fluid volume according to the fluid outlet pressure. A motor system can be mechanically engaged to the rotating member so as to rotate the member about the longitudinal axis. The first volume of the process fluid can be in fluid communication with and be at about the same pressure as the fluid outlet, and the second volume of the process fluid can be in fluid communication with and be at about the same pressure as the fluid inlet. The first and second volumes can be separated by a narrow balance piston channel.

According to some embodiments, the balance piston is positioned closer to the fluid inlet than the fluid outlet. The machine can also include a second dynamic seal configured to form a mechanical seal between a rotating portion and a non-rotating portion of the machine. The second dynamic seal has a barrier fluid volume on one side, and on the other side a volume of the process fluid that is in communication with and is about the same pressure as the fluid outlet.

According to some embodiments, the machine is configured for subsea deployment. The machine can be a subsea pump or compressor. The process fluid can be a hydrocarbon effluent produced from a subterranean rock formation. According to some other embodiments, the process fluid is water (e.g. seawater or separated produced water) being injected into a subterranean wellbore. The machine can be configured for deployment in an application where pressure variation at the fluid outlet is expected to be less than pressure variation at the fluid inlet.

According to some embodiments, a method of increasing pressure of a process fluid is described. The method includes rotating with a motor system a rotating member about a central longitudinal axis so as to cause a plurality of impellers mounted to the shaft to engage and increase fluid pressure of the process fluid along from an inlet towards and outlet, thereby causing a reaction force to be imparted on the rotating member in an axial direction from the outlet towards the inlet. The rotating member is in a fixed mounted relationship with a rotating balance piston that includes a first higher pressure surface area exposed to a first volume of the process fluid and a second lower pressure surface exposed to a second volume of the process fluid. The first and second volumes are configured such that while the member is rotating, fluid pressure in the first volume is higher than in the second volume, thereby imparting a force on the rotating member that at least partially counteracts the reaction force. A dynamic seal is configured to form a mechanical seal between the rotating balance piston and a non-rotating portion. The dynamic seal includes first and second seal portions separated by a seal channel. The seal channel separates a barrier fluid volume from first volume of the process fluid.

BRIEF DESCRIPTION OF THE DRAWINGS

The subject disclosure is further described in the following detailed description, in reference to the following drawings of non-limiting embodiments of the subject disclosure. The features depicted in the figures are not necessarily shown to scale. Certain features of the embodiments may be shown exaggerated in scale or in somewhat schematic form, and some details of elements may not be shown in the interest of clarity and conciseness. Like reference numbers and designations in the various drawings indicate like elements.

DETAILED DESCRIPTION

Figure 1:
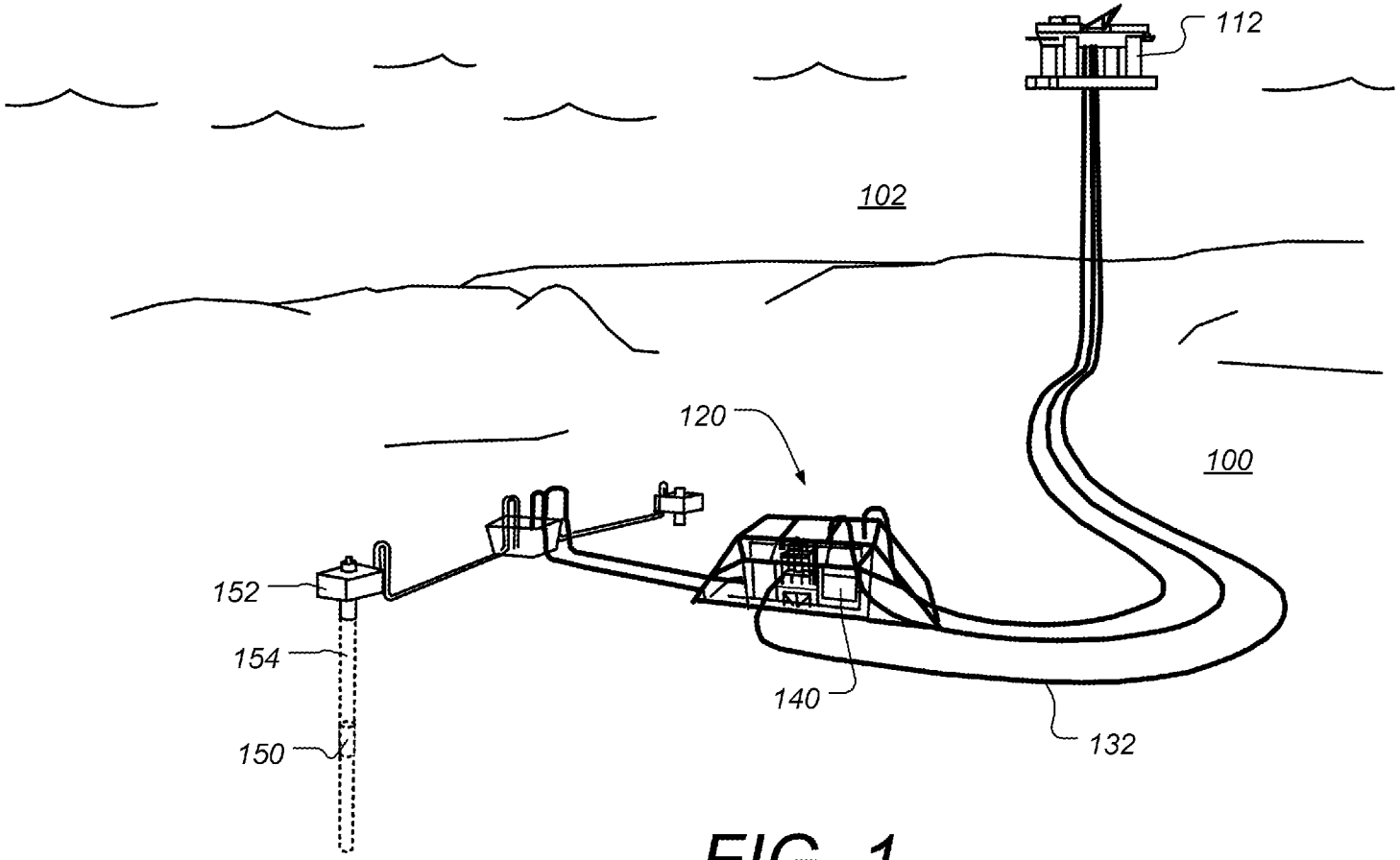
FIG. 1 is a diagram illustrating a subsea environment in which a fluid processing machine having an inlet-positioned balance piston can be deployed, according to some embodiments.

One or more specific embodiments of the present disclosure will be described below. The particulars shown herein are by way of example, and for purposes of illustrative discussion of the embodiments of the subject disclosure only, and are presented in the cause of providing what is believed to be the most useful and readily understood description of the principles and conceptual aspects of the subject disclosure. In this regard, no attempt is made to show structural details of the subject disclosure in more detail than is necessary for the fundamental understanding of the subject disclosure, the description taken with the drawings making apparent to those skilled in the art how the several forms of the subject disclosure may be embodied in practice. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are used in an open-ended fashion, and thus should be interpreted to mean "including, but not limited to." Also, any use of any form of the terms "connect," "engage," "couple," "attach," or any other term describing an interaction between elements is intended to mean either an indirect or a direct interaction between the elements described. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components.

Certain terms are used throughout the description and claims to refer to particular features or components. As one skilled in the art will appreciate, different persons may refer to the same feature or component by different names. This document does not intend to distinguish between components or features that differ in name but not function.

In subsea pumps and compressors the axial force due to the thrust load of the impeller stages can be a major challenge. If all the impellers of the subsea pump face in the same direction, the total theoretical hydraulic axial thrust acting towards the suction end of the pump will be the sum of the thrust from the individual impellers. The resultant axial force needs to be counteracted mechanically and/or hydraulically. A thrust bearing can be designed to absorb some of the thrust load. However, for relatively high differential pressures, the forces on a thrust bearing alone can make the bearing impractical due to being out of proportion structurally. Additionally, it has been found that the rotor-dynamic effects of such unbalanced resultant forces are often unacceptable.

A balance piston can be used to counteract some or all of the resultant thrust force for high differential pressure pumps and/or compressors. The balance piston is commonly located at or near the discharge (or outlet) end of the pump or compressor. It is also common for subsea booster pumps to have two mechanical seals: one located at pump suction side and one located at discharge side. Both mechanical seals are typically pressurized from a common barrier fluid system. In general, barrier fluid acts as a barrier against an outside environment and/or process fluid. Barrier fluid, which is typically an oil, can also serve other functions such as lubricating various bearing surfaces and seals, cooling of various elements and electrical insulation. When the balance piston is located near the pump outlet side, it is common for the mechanical seals to be exposed to the pump suction pressure on the process fluid side of each of the seals.

For deep-water pump applications such as boosting well-stream production, as shown in FIG. 1, the process pressure variation is mostly related to the pump suction side. It is therefore advantageous for the barrier fluid system to regulate its pressure according to the pump discharge pressure. According to some embodiments, a balance piston is positioned in a location such that both mechanical seals are exposed to the pump discharge pressure on the process side.

FIG. 1 is a diagram illustrating a subsea environment in which a fluid processing machine having an inlet-positioned balance piston can be deployed, according to some embodiments. On sea floor 100 a subsea station 120 is shown which is downstream of several wellheads being used, for example, to produce hydrocarbon-bearing fluid from a subterranean rock formation. Station 120 includes a subsea fluid processing module 140, which is powered by one or more electric motors, such as induction motors or permanent magnet motors. According to some embodiments, module 140 includes a rotating machine such as a compressor and/or pump. The station 120 is connected to one or more umbilical cables, such as umbilical 132. The umbilicals (e.g., umbilical 132) in this case are being run from a platform 112 through seawater 102, along sea floor 100 and to station 120. In other cases, the umbilicals (e.g., umbilical 132) may be run from some other surface facility such as a floating production, storage and offloading unit (FPSO), or a shore-based facility. The umbilical 132 is also used to supply barrier fluid to station 120. The umbilical 132 can also be used to supply other fluids to station 120, as well as include control and data lines for use with the subsea equipment in station 120. According to some embodiments, module 140 is configured for subsea fluid processing functions such as subsea pumping, subsea compressing and/or subsea separation. In all embodiments described herein, it is understood that references to subsea compressors and compressor modules can alternatively refer to subsea pump and pumping modules. Furthermore, references herein to subsea compressors and subsea pumps should be understood to refer equally to subsea compressors and pumps for single phase liquids, single phase gases, or multiphase fluids. According to some embodiments, the pump designs with inlet-positioned balance pistons described herein are used in connection with an electrical submersible pump (ESP) 150 which can either be located downhole, as shown in wellbore 154 in FIG. 1, or it can be located in a subsea location such as on the sea floor 100 in a Christmas tree at wellhead 152.

Figure 2:
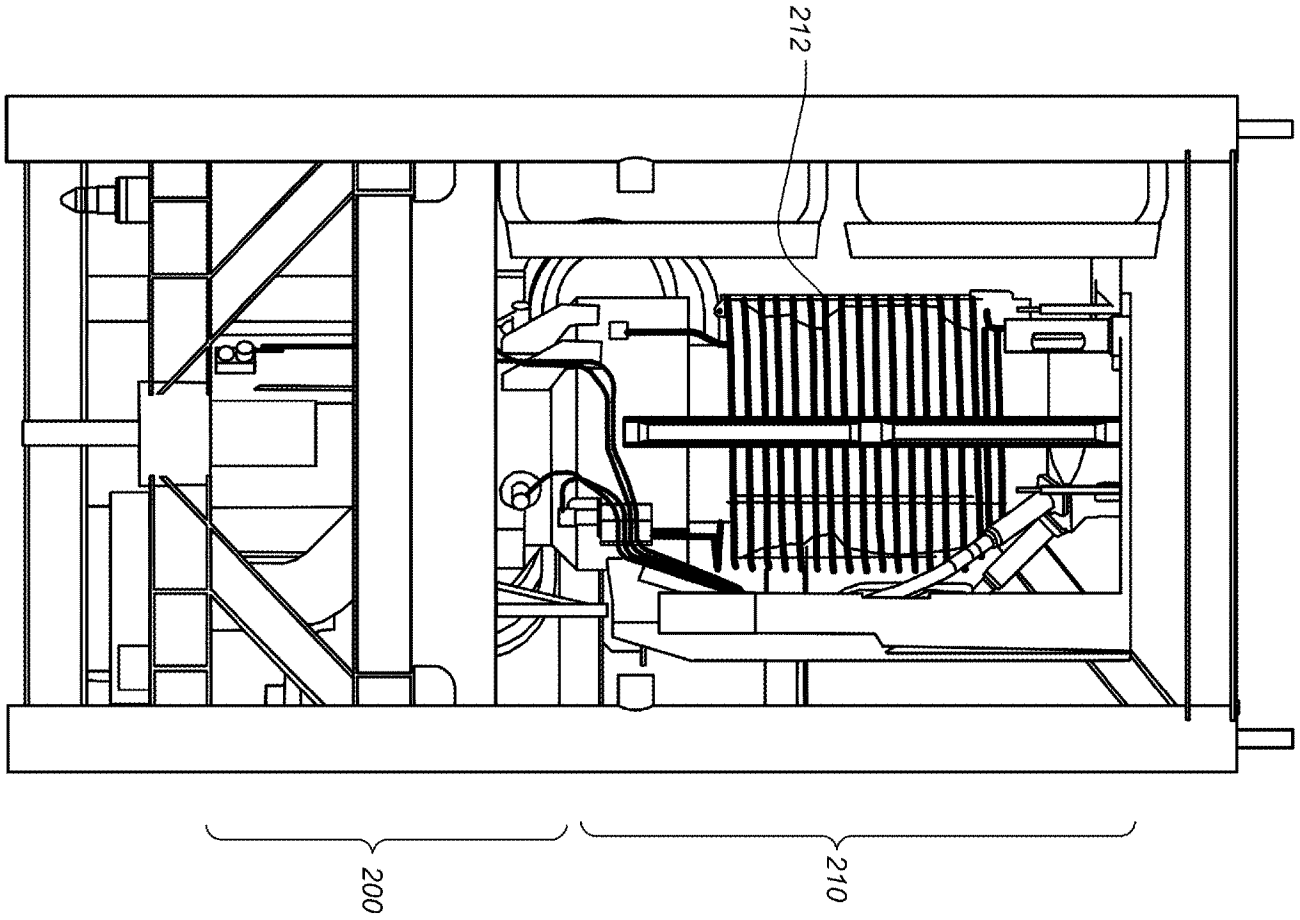
FIG. 2 is a diagram illustrating a subsea pump/compressor configured to process fluid in a subsea environment, according to some embodiments.

FIG. 2 is a diagram illustrating a subsea pump/compressor configured to process fluid in a subsea environment, according to some embodiments. Note that throughout this disclosure, subsea pump 200 is referred to as a "pump" and in some of the figures a pump is depicted and pumping is described. However, according to some embodiments, analogous structures and techniques are applied to a subsea compressor. Thus according to such embodiments, a subsea compressor is substituted in place of the described and/or depicted subsea pump. Similarly, the terms "pump/compressor" as used herein refers to a pump (such as shown in many of the figures) a well as to a compressor (which can be substituted for a pump). Subsea module 140 includes a subsea pump 200 driven by a subsea motor 210. According to some embodiments, subsea motor 210 is a barrier fluid filled motor that is supplied with barrier fluid via an umbilical (e.g., umbilical 132) from the surface (as shown in FIG. 1). According to some embodiments, motor 210 also includes a circumferentially-arranged barrier fluid cooling coil 212.

Figure 3A:
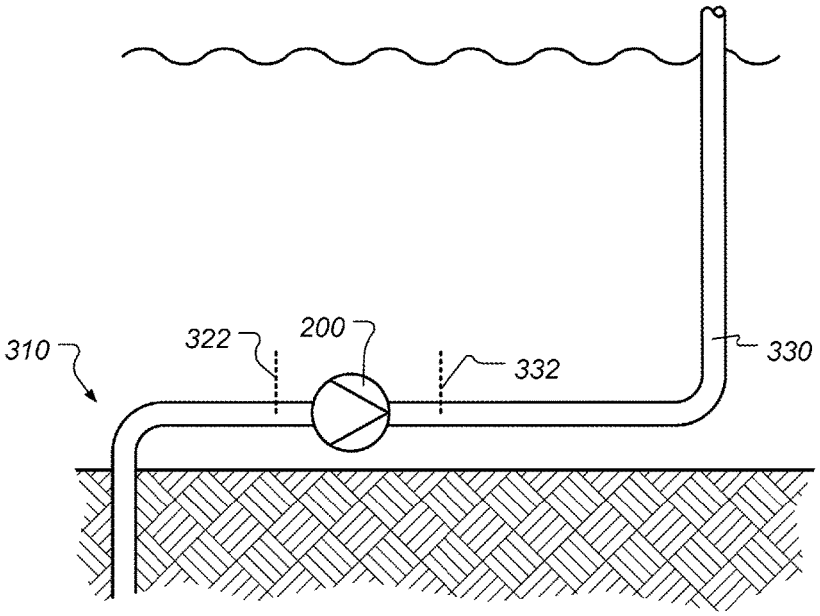
FIGS. 3A-3B are diagrams illustrating some aspects of subsea pumping applications, according to some embodiments.
Figure 3B:
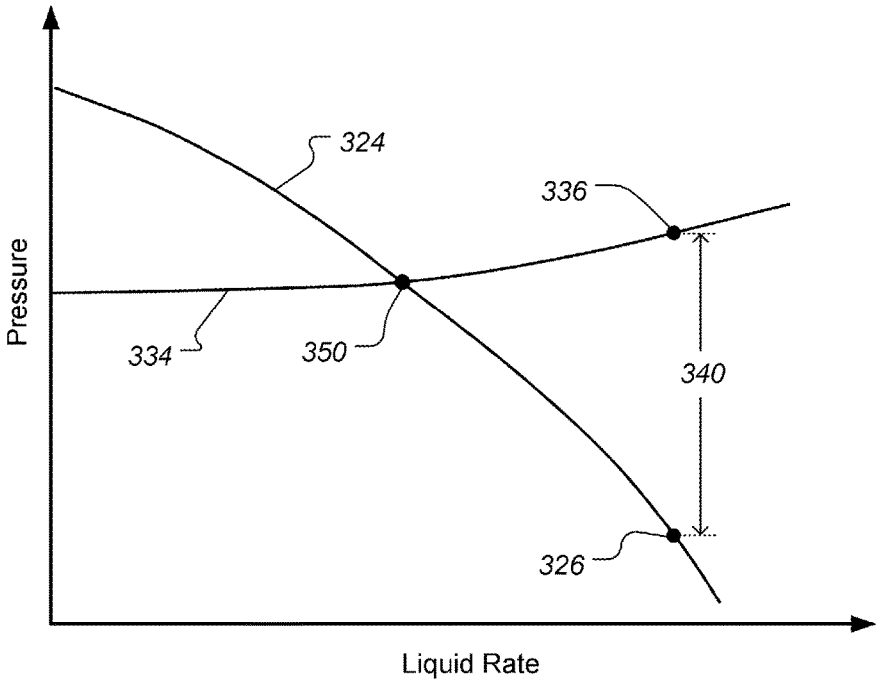

FIGS. 3A-3B are diagrams illustrating some aspects of subsea pumping applications, according to some embodiments. FIG. 3A shows a simple subsea pumping application where fluid produced from well 310 is being boosted using subsea pump 200. The pump 200 creates a differential pressure between the inflow pressure 322 and outflow pressure 332 which is the inlet pressure of the flowline 330. The main principle behind subsea boosting of wellstream production from a well, such as well 310, is to use a subsea pump, such as pump 200, to reduce the upstream pressure with the pressure differential the pump can produce. FIG. 3B is a graph plotting the pump inlet pressure and flowline inlet pressure as a function of flow rate. Curve 324 shows the inlet pressure 322 (in FIG. 3A) and curve 334 shows the flowline inlet pressure 332 (also in FIG. 3A). In operation, the differential pressure 340 can be depicted as the difference between curves 334 and 324 at a particular flow rate. Some of the differential pressure from pump 200 leads to higher downstream (discharge) pressure because of added friction losses in the flow line/riser 330 due to increased production flow rates. This is shown in FIG. 3B by the slight upward slope of curve 334. However, the majority of the differential pressure from pump 200 leads to draw down of the upstream (suction) pressure. This is particularly the case for deep-water applications where the major component for the discharge pressure 332 is the liquid column static head on flowline 330.

During a pump stop/trip the suction pressure (curve 324) will rapidly increase to the point where the inflow pressure curve 324 and flowline inlet pressure curve 334 cross, namely at location 350. Note that during a pump stop/trip the discharge pressure 334 only slightly decreases from point 336 to point 350 while the suction pressure increases much more from point 326 to point 350. Similarly, during a pump start-up the suction pressure will decrease drastically from point 350 to point 326 while the discharge pressure will only slightly increase from point 350 to point 336.

The barrier fluid provides lubricity to the bearings, cooling to the electrical motor, and serves as a barrier towards contamination ingress. The subsea pump is designed with internal mechanical seals only, i.e. the shaft is fully encapsulated by the pump and motor casing. The pump barrier fluid system can also provide a di-electrical fluid that drives the subsea boosting pump, depending on the type of barrier fluid used.

The subsea pump has two mechanical seals, with one located at the bottom of the pump and the other on top of the pump below the motor. The mechanical seals are pressurized with barrier fluid on the inside and have the process fluid on the outside. The barrier system is designed to maintain a set overpressure to the process pressure within a specified range.

In conventional balance piston designs, the balance piston is located at pump outlet (pump discharge). The balance piston flow is routed from the last impeller (often the top part of the pump), upwards to the balance piston. The process fluid then flows past a discharge end mechanical seal, and back down to the bottom end of the pump via bores or/and piping to the pump suction side and past a suction side mechanical seal. In such a design, both mechanical seals are exposed to the pump suction pressure, which means that the barrier fluid pressure needs to regulate according to pump suction pressure.

From FIGS. 3A and 3B, supra, it can be seen that for deep water boost pumping applications, the process pressure variation is mainly on the pump suction side. It is therefore an advantage if the mechanical seals are exposed to the pump discharge pressure, which is quite stable during pump operations including pump stops/trips and pump start ups.

Figure 4:
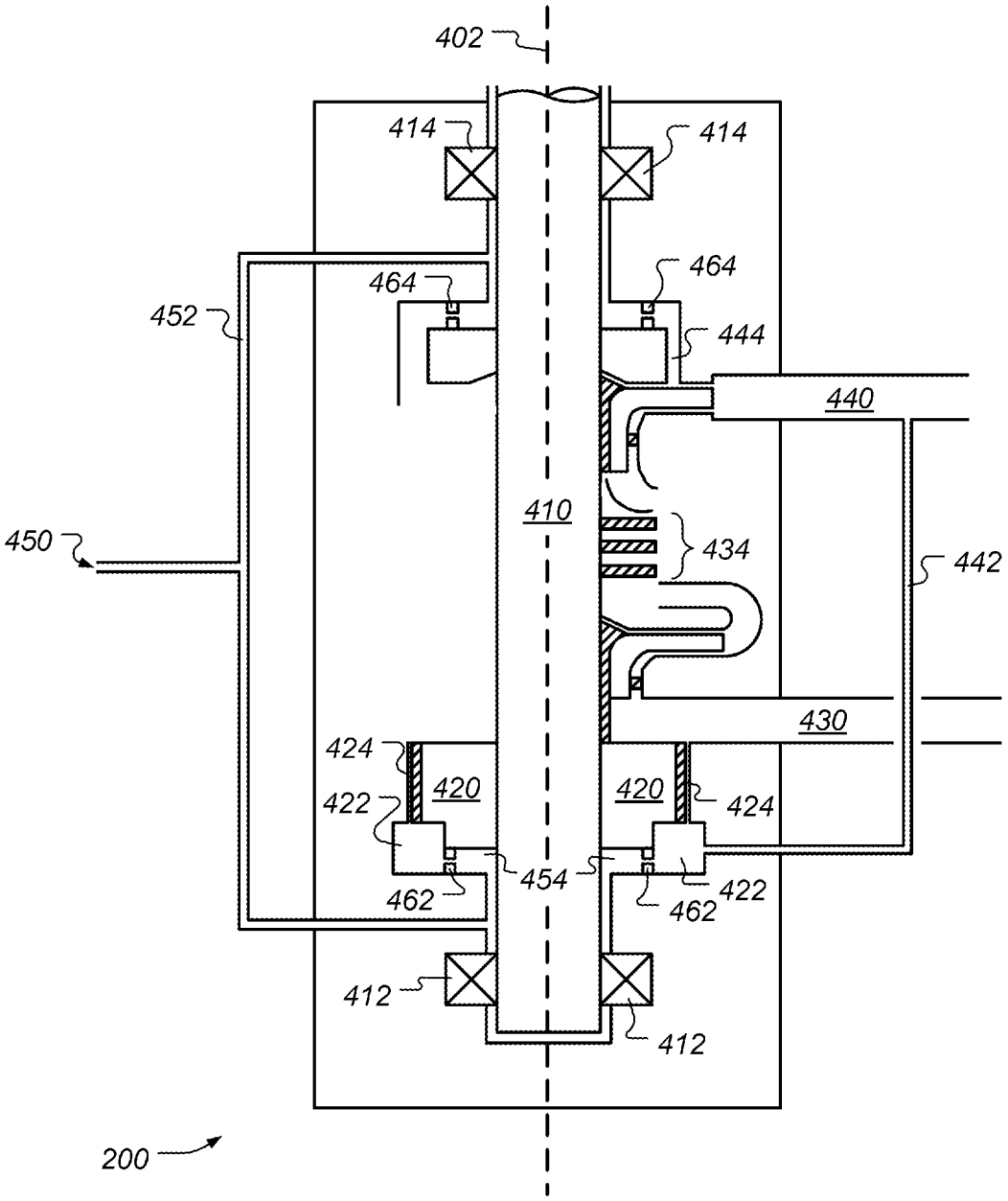
FIG. 4 is a diagram illustrating aspects of a subsea pump with a balance piston in its inlet, according to some embodiments.

FIG. 4 is a diagram illustrating aspects of a subsea pump with a balance piston in its inlet, according to some embodiments. In the design shown in FIG. 4, the balance piston is positioned at pump inlet instead of the pump outlet as in conventional designs. In FIG. 4, subsea pump 200 includes a balance piston 420 positioned on shaft 410 near the pump inlet 430, rather than the pump outlet 440. As shaft 410 rotates about axis 402, the process fluid is drawn into pump inlet 430. Pressure is increased in a fluid processing chamber (which is the volume between pump inlet 430 and pump outlet 440) using a plurality of impeller stages 434, and then the process fluid is discharged through pump outlet 440. Lower and upper bearings 412 and 414, respectively, are shown schematically. There are two mechanical (dynamic) seals—lower mechanical seal 462 and upper mechanical seal 464. Each mechanical/dynamic seal includes rotating and non-rotating parts that are separated by a seal channel. A barrier fluid supply system supplies barrier fluid through conduits 450 and 452 to one side of each of the mechanical seals 462 and 464. The barrier fluid is maintained at an overpressure which ranges, for example of 25-30 bar above the process fluid on the other side of the seals (for example the barrier fluid in the inner side of mechanical seals 462 is maintained at 25-30 bar above the fluid pressure in volume 422). According to some embodiments, the mechanical seals 462 and 464 are arranged horizontally as shown in FIG. 4 so that centrifugal forces further bias the flow through the respective seal channels from the barrier fluid side towards the process fluid side. Note that in the example shown in FIG. 4 mechanical seals 462 and 464 have an internal barrier fluid overpressure (i.e. the barrier fluid overpressure is on the innermost sides of the mechanical seals). However, according to some embodiments the balance piston location and arrangement close to the inlet can also be used in a pump with an external barrier fluid overpressure design (i.e. the barrier fluid overpressure is on the outermost sides of the mechanical seals).

Process fluid flowing past the last (highest) of the impellers 434 flows past the discharge end mechanical seal 464 (also referred to as the "drive end" mechanical seal since in some embodiments the motor drive mounted above pump, as shown in FIG. 2), which is connected to pump outlet 440 via conduit 444. While most of the process fluid flows out of the pump 200 via outlet 440, a small portion of process fluid flows down to the bottom end of the pump via bores or/and piping 442 past the suction end mechanical seal 462 at volume 422. From volume 422, the fluid flows upwards through narrow channel 424 which is partially formed by the outer surface of balance piston 420. After channel 424, the fluid flows back to the pump suction 430. The balance piston 420 has lower surface that is exposed to a higher pressure (in volumes 454 and 422) and an upper surface that is exposed to a lower pressure (in pump inlet 430). As a result, the balance piston pushes upwards on the shaft 410 which partially or fully counteracts the downward force generated by the interaction of the impellers 434 on the process fluid. Note that with a design such as shown in FIG. 4, the downstream end of both mechanical seals 462 and 464 are exposed to the pump discharge pressure.

Note that the design shown in FIG. 4 is for a pump having its suction side on its lower end and its discharge side on its upper end. The described arrangement with the balance piston at its inlet could alternatively be achieved with an opposite configuration (i.e. suction on its upper end) or using a horizontal pump. The positioning of the balance piston at the inlet, and the mechanical seals being exposed to the pump discharge pressure is also not dependent on selected hydraulics, single phase, multiphase phase or combined phases.

By exposing the downstream side of the both mechanical seals 462 and 464 to the discharge (outlet) pressure rather than the suction (inlet) pressure, the regulation of barrier fluid overpressure can be greatly simplified since the discharge pressure is far less variable then the suction pressure in many application, as is shown in FIGS. 3A and 3B.

While the application depicted in FIG. 3A is related to boosting a wellstream, according to so some embodiments, the design in FIG. 4 is generally applicable to any application where the majority of pumped fluid pressure variation is related to the pump suction side rather than the pump discharge side.

Figure 5:
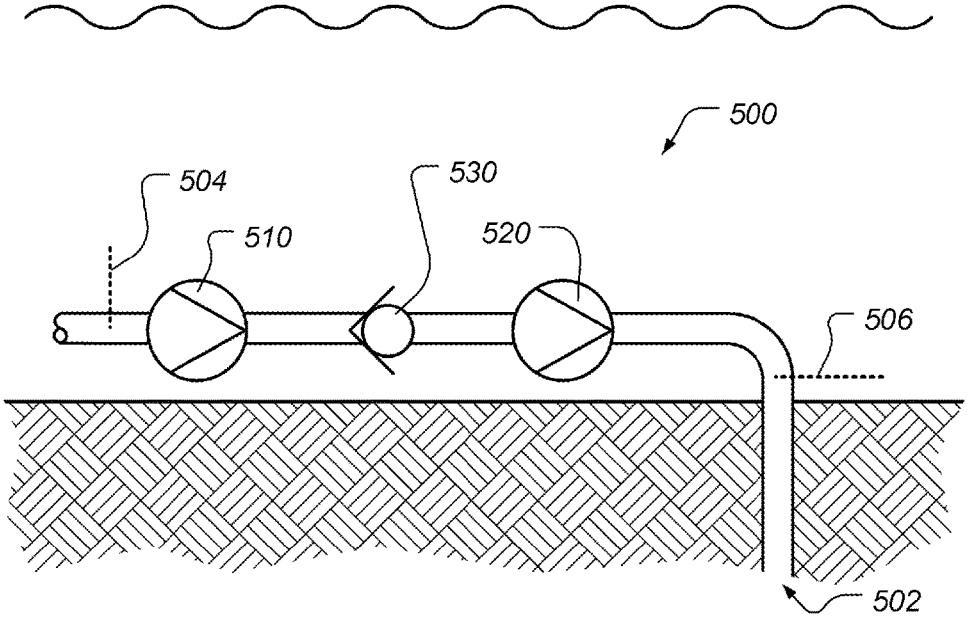
FIG. 5 is a diagram illustrating a two-pump water injection system in which one of the pumps has an inlet-positioned balance piston, according to some embodiments.

FIG. 5 is a diagram illustrating a two-pump water injection system in which one of the pumps has an inlet-positioned balance piston, according to some embodiments. A raw subsea water injection system 500 is used to inject seawater into well 502. Two pumps 510 and 520 are used in series to achieve a high pressure differential between inlet pressure 504 and injection pressure 506. The pumps 510 and 520 are separated by a check valve 530. The first pump 510 has a balance piston conventionally located at its pump outlet which means that both mechanical seals at pump inlet and outlet of pump 510 face the pump suction pressure 504. The second pump 520 has its balance piston located at its pump inlet, such as depicted in FIG. 4. Both of the mechanical seals of pump 520 therefore are exposed to the discharge pressure 506 of pump 520.

In operation, when raw seawater injection system 500 is started up after a pump stop or trip the first pump 510 will face the seawater head pressure which is close to the pump suction prior to stop/trip. Due to check valve 530 the second pump 520 will face a slightly decreasing discharge pressure. The second pump 520 will initially have an excess pressure on the barrier fluid side of the seals which can gradually be decreased as the supply pressure drops. According to some embodiments, water from other sources, such as produced water from a subsea separator can be injected using system 500 instead of raw seawater.

Figure 6:
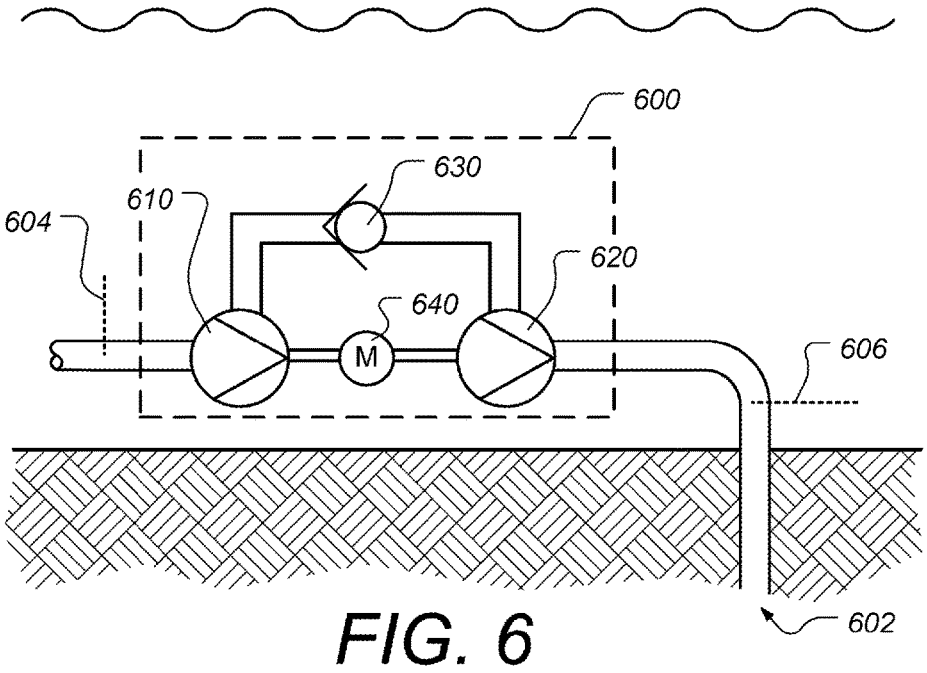
FIG. 6 is a diagram illustrating a water injection system in which a single motor drives two sets of impellers, according to some embodiments.

FIG. 6 is a diagram illustrating a water injection system in which a single motor drives two sets of impellers, according to some embodiments. The seawater pumping unit 600 is configured to inject raw seawater into well 602. The pumping unit 600 includes one electrical motor 640 driving two sets of impellers 610 and 620, with one impeller set being positioned on each end of the motor 640. A check valve 630 is disposed between the impeller sets 610, 620 that allows fluid to flow from the impeller set 610 to the impeller set 620, but restricts fluid from flowing from the impeller set 620 to the impeller set 610. Similarly to the embodiments depicted in FIG. 5, the first impeller set 610 at the inlet has the balance piston conventionally located at pump outlet which means that both the mechanical seals of impeller set 610 face the suction pressure 604. The second impeller set 620 has its balance piston located at the inlet of set 620 which means that both mechanical seals of set 620 face the pump discharge pressure 606.

Figure 7:
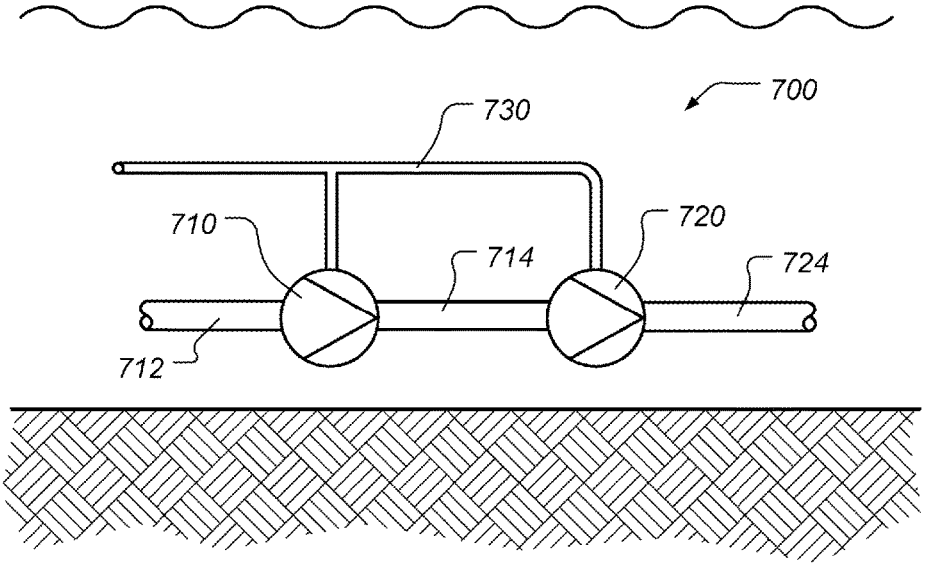
FIG. 7 is a diagram illustrating a subsea pumping system, according to some embodiments.

FIG. 7 is a diagram illustrating a subsea pumping system, according to some embodiments. Subsea pumping system 700 includes a first pump 710 that has a balance piston near its pump inlet 712 and its barrier fluid is regulated according to the fluid pressure of the discharge 714 of pump 710 (for example as in the case shown in FIG. 4). The second pump 720 has its balance piston located near its pump outlet 724 and its barrier fluid pressure is regulated according to the pressure at the suction (inlet 714) of pump 720. An advantage of this arrangement is that both pumps 710 and 720 regulated their barrier fluid pressure according to the same pressure: the fluid pressure of location 714 (which is both the outlet of pump 710 and the inlet of pump 720). The barrier fluid supply system 730 can therefore run from a common umbilical line or from the same line of a subsea distribution/regulating system. Note that check valves have not been included for clarity and the location(s) of check valves would vary according to the application. For example, a check valve could be located either upstream of the first pump, between the pumps, downstream of the second pump, or a combination of these locations. According to some embodiments the arrangement shown in FIG. 7 is used for multiphase boosting where the first pump 710 is a multiphase pump. In this case the multiphase pump 710 increases the pressure above the pumped fluid's bubble point such that the second pump 720 can be a single phase pump. According to some embodiments, the two pumps 710 and 720 could be run from a single electric motor such as depicted in FIG. 6.

Although several of the embodiments have been described in a subsea fluid processing setting, according to some embodiments, positioning the balance piston on the pump inlet such that its mechanical seals face the pump outlet pressure can also be applied to topside applications, especially where the pump discharge (outlet) tends to see less pressure variation than the pump suction (inlet).

While the subject disclosure is described through the above embodiments, modifications to and variations of the illustrated embodiments may be made without departing from the inventive concepts herein disclosed. These and other variations and modifications will become apparent to those skilled in the art once the above disclosure is fully appreciated. It is intended that the following claims be interpreted to embrace all such variations and modifications.

What is claimed is:

1. A fluid pressure increasing machine comprising:

a fluid processing chamber configured to contain a process fluid and including a fluid inlet and a fluid outlet;

a rotating member configured to rotate about a central longitudinal axis;

a plurality of impellers being fixedly mounted to the rotating member and exposed to the process fluid within the fluid processing chamber such that when the member is rotated the impellers act on the process fluid thereby increasing pressure of the process fluid towards the fluid outlet and a reaction force is imparted on the rotating member in an axial direction from the fluid outlet toward the fluid inlet;

a rotating balance piston mounted in a fixed relationship with the rotating member including a first higher pressure surface area exposed to a first volume of the process fluid and a second lower pressure surface exposed to a second volume of the process fluid, the first volume being in fluid communication with and about the same pressure as the fluid outlet, and the first and second volumes configured such that while the member is rotating, fluid pressure in the first volume is higher than in the second volume, thereby imparting a force on the rotating member which at least partially counteracts the reaction force; and a dynamic seal configured to form a mechanical seal between the rotating balance piston and a non-rotating portion of the machine, the dynamic seal comprising first and second seal portions separated by a seal channel, the seal channel separating a barrier fluid volume from said first volume of the process fluid.

2. The machine according to claim 1 further comprising a barrier fluid pressure regulation system configured to regulate pressure of barrier fluid in the barrier fluid volume according to the fluid outlet pressure.

3. The fluid processing machine according to claim 2 wherein the barrier fluid pressure regulation system is further configured to regulate pressure of barrier fluid of a second fluid pump according to said fluid outlet pressure.

4. The machine according to claim 1 further comprising a motor system mechanically engaged to the rotating member so as to rotate the member about the longitudinal axis.

5. The fluid processing machine according to claim 4 wherein the motor system mechanically engaged to a second pump configured in series with the fluid processing machine.

6. The machine according to claim 1 wherein the second volume of the process fluid is in fluid communication with and is about the same pressure as the fluid inlet.

7. The machine according to claim 1 wherein the first volume and the second volume are separated by a narrow balance piston channel.

8. The machine according to claim 1 wherein the balance piston is positioned closer to the fluid inlet than the fluid outlet.

9. The machine according to claim 1 further comprising a second dynamic seal configured to form a mechanical seal between a rotating portion and a non-rotating portion of the machine, the second dynamic seal comprising first and second seal portions separated by a seal channel, the seal channel separating a barrier fluid volume from a volume of the process fluid that is in fluid communication with and is about the same pressure as the fluid outlet, wherein the a barrier fluid pressure regulation system is configured regulate pressure of barrier fluid in the barrier fluid volumes of the dynamic seal and the second dynamic seal according to the fluid outlet pressure.

10. The machine according to claim 1 wherein the machine is configured for subsea deployment.

11. The machine according to claim 10 wherein the machine is a subsea pump.

12. The machine according to claim 11 wherein the process fluid is a hydrocarbon effluent produced from a subterranean rock formation.

13. The machine according to claim 11 wherein the process fluid is water being injected into a subterranean wellbore.

14. The machine according to claim 13 wherein the process fluid is of a type selected from a group consisting of: raw seawater and produced water from a subsea separator.

15. The machine according to claim 13 wherein the machine is configured to be positioned downstream of a second subsea pump and a check valve.

16. The machine according to claim 1 wherein the machine is configured for deployment in an application where pressure variation at the fluid outlet is expected to be less than pressure variation at the fluid inlet.

17. The machine according to claim 1 wherein the machine is an electrical submersible pump deployable within a wellbore.

18. The fluid processing machine of claim 1 wherein the force imparted on the rotating member from the balance piston counteracts at least 25% of the reaction force.

19. A method of increasing pressure of a process fluid comprising rotating with a motor system a rotating member about a central longitudinal axis so as to cause a plurality of impellers mounted to the shaft to engage and increase fluid pressure of the process fluid along from an inlet towards and outlet thereby causing a reaction force to be imparted on the rotating member in an axial direction from the outlet towards the inlet, the rotating member also being in a fixed mounted relationship with a rotating balance piston including a first higher pressure surface area exposed to a first volume of the process fluid and a second lower pressure surface exposed to a second volume of the process fluid, the first volume being in fluid communication with and about the same pressure as the fluid outlet, the first and second volumes being configured such that while the member is rotating, fluid pressure in the first volume is higher than in the second volume, thereby imparting a force on the rotating member which at least partially counteracts the reaction force, wherein a dynamic seal is configured to form a mechanical seal between the rotating balance piston and a non-rotating portion, the dynamic seal comprising first and second seal portions separated by a seal channel, the seal channel separating a barrier fluid volume from said first volume of the process fluid.

20. The method according to claim 19 wherein the second volume of the process fluid is in fluid communication with and is about the same pressure as the inlet.

21. The method according to claim 19 wherein the balance piston is positioned closer to the inlet than the outlet.

22. The method according to claim 19 wherein the method is carried out in a subsea environment.

23. The method according to claim 19 wherein the process fluid is a hydrocarbon effluent produced from a subterranean rock formation.

24. The method according to claim 19 wherein the process fluid is water being injected into a subterranean wellbore.

25. The method according to claim 24 wherein the process fluid is of a type selected from a group consisting of: raw seawater and produced water from a subsea separator.

26. The method according to claim 19 wherein pressure variation at the outlet is less than pressure variation at the inlet.

27. The method according to claim 19 further comprising regulating the barrier fluid in the barrier fluid volume according to pressure of the fluid outlet.

* * * * *